US010259006B2

(12) United States Patent
Bradley

(10) Patent No.: US 10,259,006 B2
(45) Date of Patent: Apr. 16, 2019

(54) EXTENSIBLE ADHESIVE DISPENSING GUN SYSTEM

(71) Applicant: OFS Fitel, LLC, Norcross, GA (US)

(72) Inventor: Kelvin B Bradley, Lawrenceville, GA (US)

(73) Assignee: OFS FITEL, LLC, Norcross, GA (US)

( * ) Notice: Subject to any disclaimer, the term of this patent is extended or adjusted under 35 U.S.C. 154(b) by 0 days.

(21) Appl. No.: 15/790,317

(22) Filed: Oct. 23, 2017

(65) Prior Publication Data

US 2018/0345313 A1 Dec. 6, 2018

Related U.S. Application Data

(60) Provisional application No. 62/531,949, filed on Jul. 13, 2017, provisional application No. 62/512,228, filed on May 30, 2017.

(51) Int. Cl.
*B05C 17/01* (2006.01)
*B05C 17/005* (2006.01)

(52) U.S. Cl.
CPC .... *B05C 17/0052* (2013.01); *B05C 17/00583* (2013.01); *B05C 17/01* (2013.01)

(58) Field of Classification Search
CPC ..... B05C 17/0052; B05C 17/00583; B05C 17/01
USPC ..... 222/326, 522–525
See application file for complete search history.

(56) References Cited

U.S. PATENT DOCUMENTS

| | | | | |
|---|---|---|---|---|
| 5,692,642 | A * | 12/1997 | Brattesani | B05C 17/01 221/199 |
| 6,454,136 | B1 * | 9/2002 | Evans | B05C 17/01 222/174 |
| 6,817,492 | B1 * | 11/2004 | Smith | B25B 27/023 222/309 |
| 8,574,385 | B2 | 11/2013 | Malofsky et al. | |
| 2013/0020015 | A1 | 1/2013 | Dickinson et al. | |
| 2014/0020815 | A1 | 1/2014 | Dickinson et al. | |
| 2015/0003884 | A1 * | 1/2015 | Kast | A01M 7/0046 401/4 |
| 2017/0160508 | A1 | 6/2017 | Burek et al. | |
| 2018/0104714 | A1 * | 4/2018 | Coe | B65D 77/0486 |

* cited by examiner

*Primary Examiner* — Jeremy Carroll
(74) *Attorney, Agent, or Firm* — Law Office of Leo Zucker, Esq.

(57) ABSTRACT

An extensible adhesive dispensing gun system. A syringe has a piston for urging an adhesive out of a nozzle, and a first mount at a back end of the syringe. A gun body contains a mechanism for advancing a plunger from a front end of the body in response to a trigger, and a second mount is disposed on the front end. An extension tube assembly includes an outer tube having near and far end adapters. A third mount on the near end adapter engages the second mount on the gun body, and a fourth mount on the far end adapter engages the first mount on the syringe. An inner rod member is arranged inside the outer tube. When the gun plunger is urged against a back end of the rod member, a leading end of the member forces the syringe piston to urge the adhesive out of the nozzle.

12 Claims, 6 Drawing Sheets

EXTENSIBLE ADHESIVE DISPENSING GUN SYSTEM

CROSS REFERENCE TO RELATED APPLICATIONS

This application claims priority under 35 U.S.C. § 119(e) of U.S. Provisional Patent Applications No. 62/512,228 filed May 30, 2017, titled Adhesive Dispensing Gun Extender, and No. 62/531,949 filed Jul. 13, 2017, titled Adhesive Dispensing Gun Extender and Plunger Head for Inner Rod Assembly. The entire contents of both applications are incorporated herein by reference.

BACKGROUND OF THE INVENTION

Field of the Invention

The present invention relates generally to adhesive applicator or dispensing systems, and particularly to an adhesive dispensing gun system capable of applying an adhesive over a surface that is out of the ordinary reach of a user.

Discussion of the Known Art

The use of desktop optical network terminals (ONTs) inside the premises of fiber optic network users, is increasing. As used herein, the term "premises" refers to a living unit, e.g., a home, office, or apartment, within which a user of a fiber optic network resides and uses services that are offered by the network, e.g., Internet access, telephony, television, voice and music broadcasts, and/or other information and data streams that require the installation of one or more optical fibers at the premises.

ONTs are typically located near a TV set top box, an Internet modem, or other device to which the ONT is connected at the premises. A need therefore exists for a procedure for routing an optical fiber over a path inside a given premises between the ONT and a network access module usually installed at an entry point of the premises, such that the fiber is routed securely, easily, quickly, and with little, if any, adverse visual impact inside the premises.

The use of staples to secure an optical fiber to an existing wall, molding, or other exposed surface over the routing path inside the premises may reduce installation time and incur relatively low cost. Stapled installations, however, are rejected by many users who opt instead for special moldings or conduit solutions to hide the fiber from view. Staples can also physically damage walls and moldings, and impair or break an optical fiber if not carefully set in place. Moreover, many users prefer to have all wire and optical fiber cables totally concealed inside their premises, which entails expensive hardware and requires substantial installation time.

Accordingly, a system that enables an installer to route and secure an optical fiber easily, quickly, and safely over exposed surfaces, grooves and/or corners inside a premises with little if any visibility is very desirable. A solution offered by OFS Fitel, LLC under the registered mark InvisiLight® meets this need by enabling fast, easy, and virtually invisible fiber installations inside premises by the use of a consumer-grade, low-odor, nonhazardous, water-based adhesive to bond buffered and jacketed fibers to walls and ceilings. Water-based adhesives are desirable since they are non-toxic, allow clean up with soap and water, and can be shipped worldwide without restriction. As the demand for InvisiLight installations has spread, users have requested that the installation time be reduced even more by addressing the following concerns.

The current process requires an installer to move and climb a ladder multiple times. First, the adhesive is applied over successive portions of the route by repositioning and climbing the ladder to reach ceilings and crown moldings along the path of the route, while the installer holds a conventional adhesive dispensing gun having a reloadable adhesive syringe. To dispense the adhesive, the installer repeatedly squeezes the gun trigger which causes a plunger to move forward and force the adhesive out of the tip of the syringe.

The installer then goes back and repeats the first series of ladder movements, climbing the ladder again when necessary so that he or she can press the fiber manually into the applied adhesive along the desired route. At most premises, however, it is difficult for the installer to set up the ladder safely next to large furniture (e.g., sofas and entertainment centers) that happen to be placed below the route.

FIG. 1 shows an adhesive dispensing gun 10 currently used in InvisiLight installations. FIG. 2 is an exploded view of the gun. The gun 10 is commercially available from, inter alia, Adhesive Dispensing, Ltd. as model TS755SG, and it includes a disposable syringe 12 in which an adhesive having the earlier mentioned properties is preloaded. The syringe 12 includes a nozzle 14 at a front end, and a hollow cup piston 16 disposed inside the opening at the back end of the syringe for urging adhesive out of the nozzle 14. A first mount 18 is fixed on the proximal end of the syringe 12. Packages containing quantities of one to 100 of the syringes 12 pre-loaded with the adhesive, are available from OFS Fitel, LLC.

The gun 10 has a body 20 which contains a trigger mechanism 22 that is responsive to a trigger 24 on a handle of the body 20. Each time the trigger 24 is pulled, the mechanism 22 advances an elongated plunger 26 out of the front end of the gun body 20 by a certain distance. See FIGS. 1 and 2. A second mount 30 fixed on the front end of the gun body 20 is formed to engage the first mount 18 on the syringe 12. Thus, when the first mount 18 is engaged with the second mount 30 on the gun body, and the gun trigger 24 is depressed one or more times, a head 28 on the plunger 26 engages and forces the syringe piston 16 to urge the adhesive out of the nozzle 14.

One solution for eliminating the need for a ladder when applying the adhesive over a surface out of the ordinary reach of an installer, is offered by OFS Fitel, LLC in the form of an extension pole assembly (OFS item #301115671), wherein the adhesive dispensing gun 10 in FIG. 1 can be mounted at a far end of the pole. A device similar to a bicycle brake lever is arranged on the near end of the pole. The device enables the installer to pull the gun trigger 24 at the far end of the pole via a cable that is linked to the lever device at the near end. While this solution works well, it is relatively expensive and it may take a while for an installer to learn to use it effectively. Accordingly, there remains a need for a lower cost solution that an installer can implement quickly and easily.

SUMMARY OF THE INVENTION

According to the invention, an extensible adhesive dispensing gun system includes a syringe for containing an adhesive, wherein the syringe has a nozzle at a front end for applying the adhesive, a piston for urging the adhesive out of the nozzle, and a first mount on a back end of the syringe.

A gun body has a front end, a second mount at the front end, a trigger mechanism arranged in the gun body and responsive to a trigger, and an elongated plunger arranged to advance from the front end of the gun body in response to operation of the trigger mechanism.

An elongated outer tube has a near end adapter, a far end adapter, a third mount on the near end adapter for engaging the second mount at the front end of the gun body, and a fourth mount on the far end adapter for engaging the first mount on the back end of the syringe.

An elongated inner rod member has a back end and a leading end. The rod member is arranged for axial movement inside the outer tube, and has a plunger head at the leading end. When gun plunger is advanced from the gun body against the back end of the rod member, the plunger head at the leading end of the rod member forces the piston in the syringe to urge the adhesive out of the nozzle.

For a better understanding of the invention, reference is made to the following description taken in conjunction with the accompanying drawing and the appended claims.

BRIEF DESCRIPTION OF THE DRAWING FIGURES

DETAILED DESCRIPTION OF THE INVENTION

Figure 3:
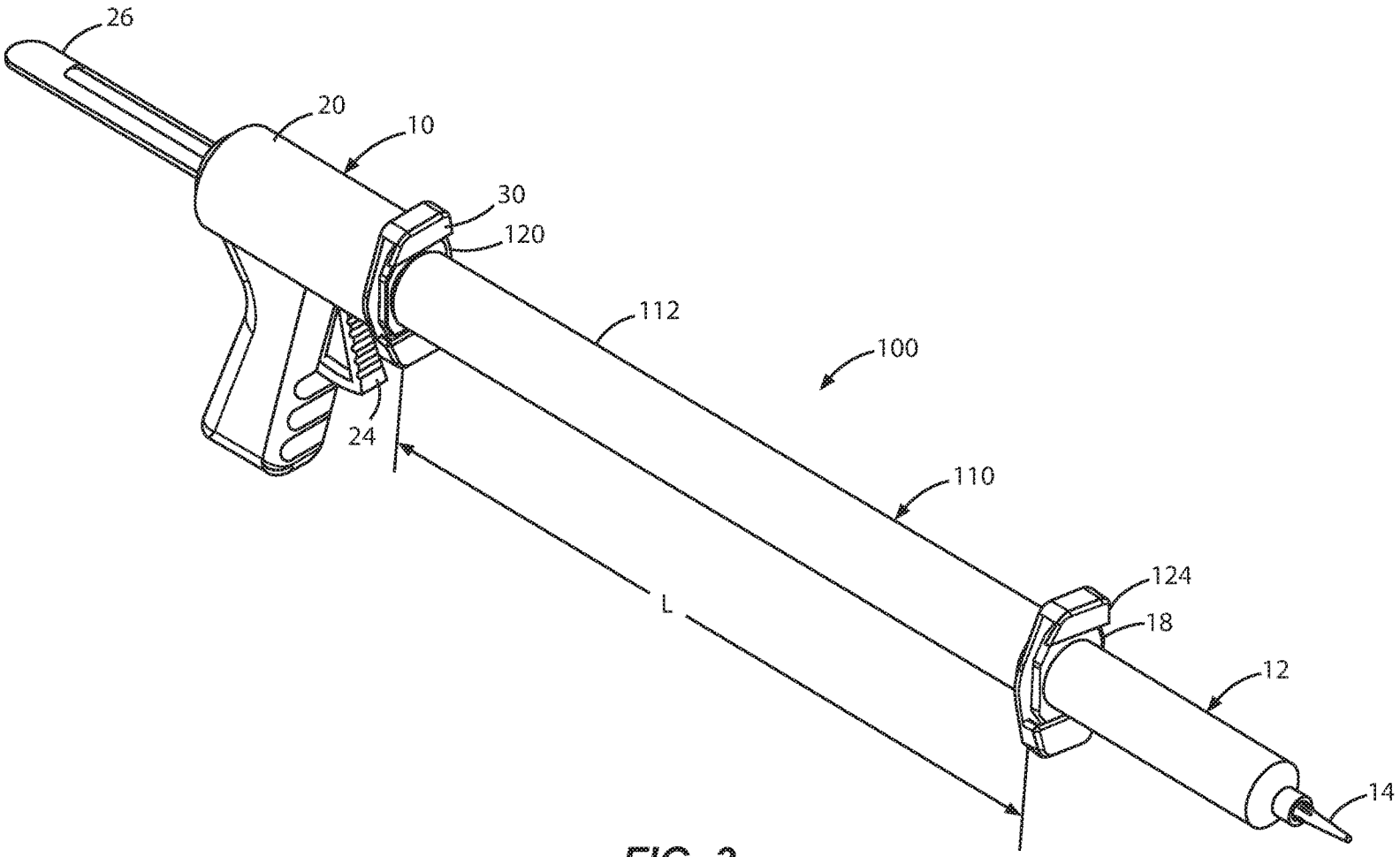
FIG. 3 is a view of an extensible adhesive gun dispensing system according to the invention when assembled with a syringe.
Figure 4:
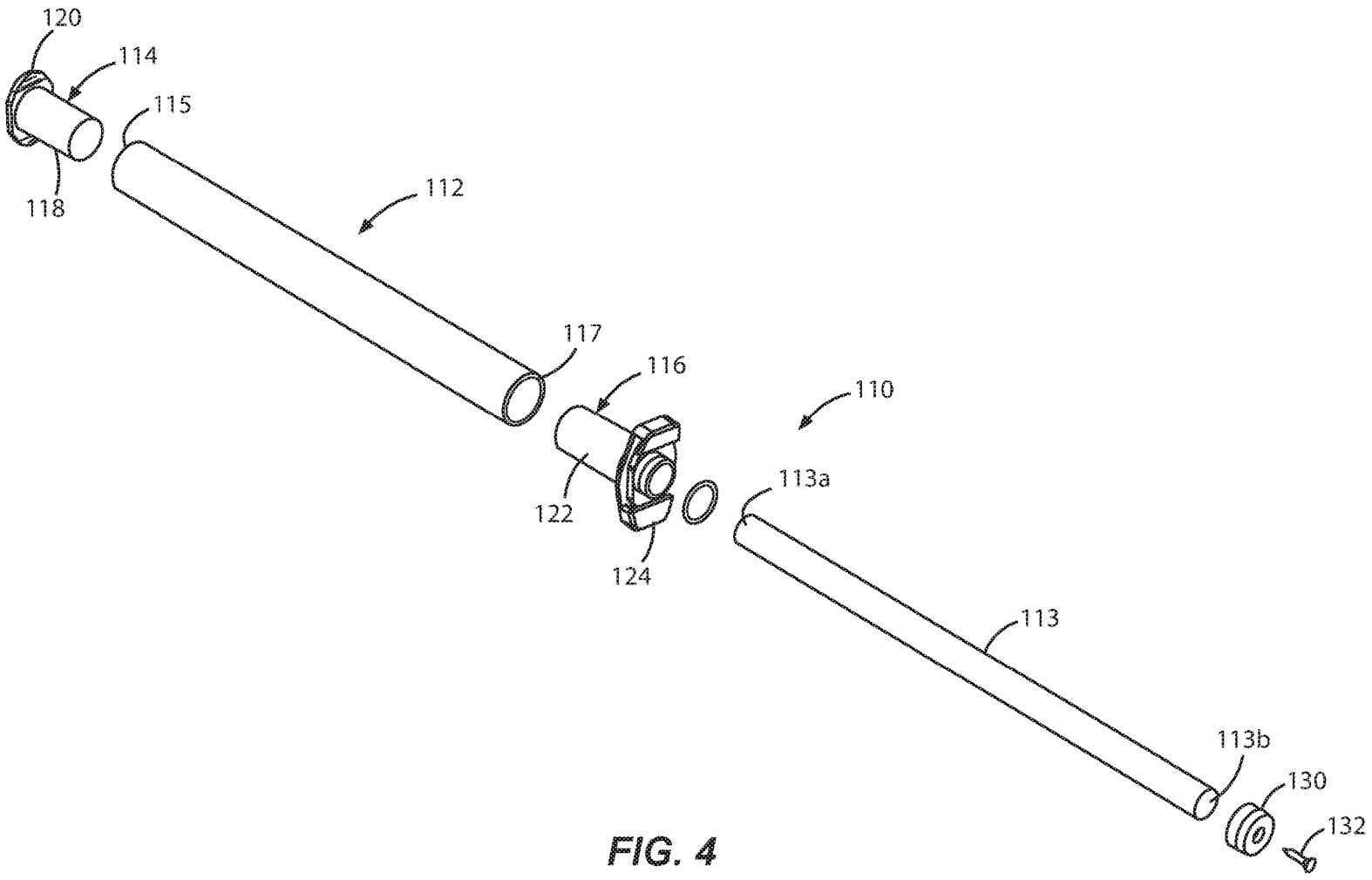
FIG. 4 is an exploded view of an extension tube assembly in the dispensing system in FIG. 3.
Figure 5:
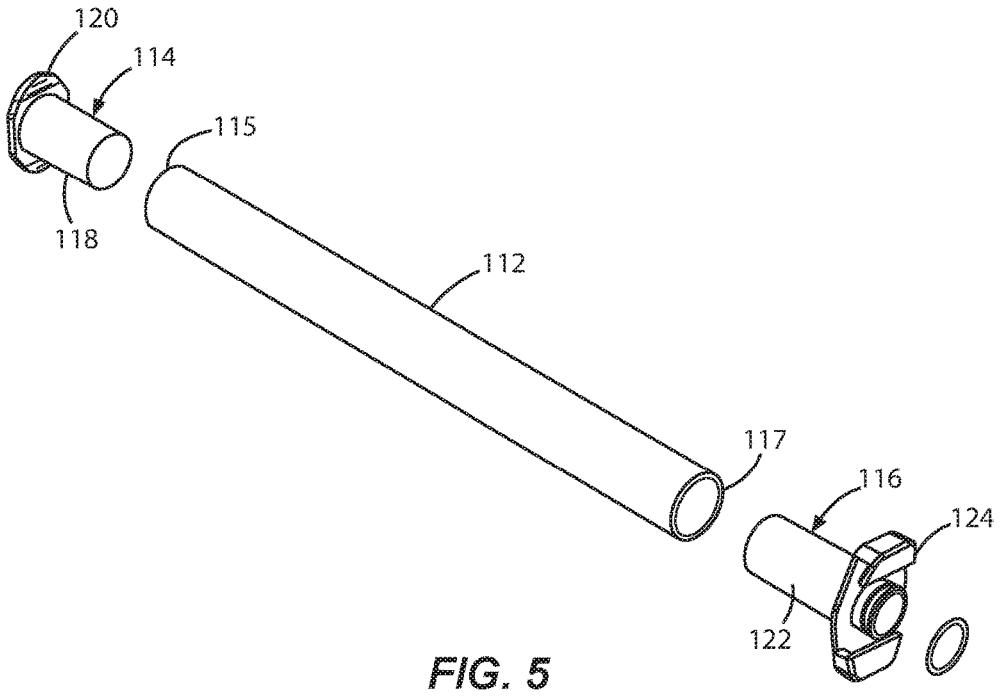
FIG. 5 is an exploded view of an outer tube in the dispensing system in FIG. 3.
Figure 6:
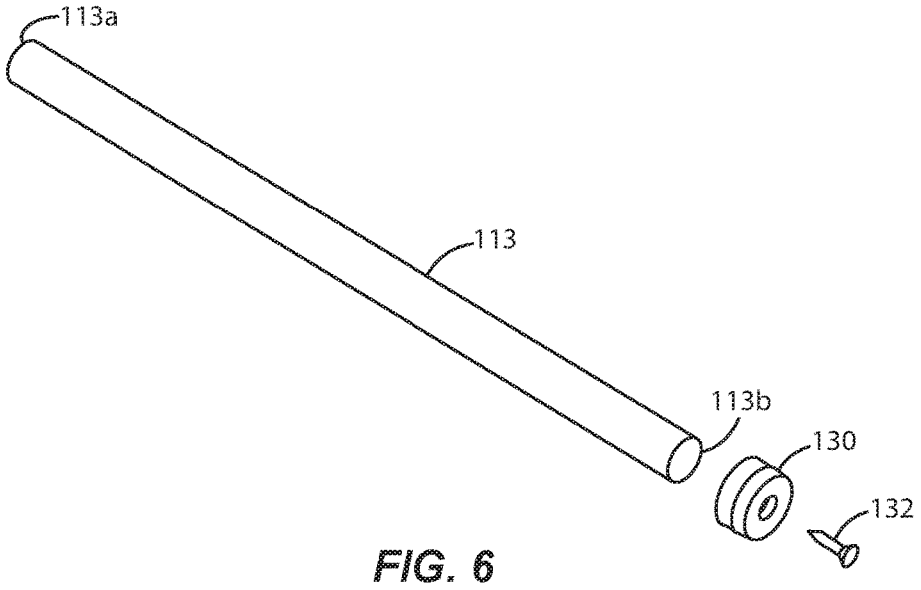
FIG. 6 is an exploded view of an elongated inner member or rod in the dispensing system in FIG. 3.

FIG. 3 is a view of an assembled extensible adhesive gun dispensing system 100 according to the invention. FIG. 4 is an exploded view of an extension tube assembly 110 in the system 100 in FIG. 3. FIGS. 5 and 6 are exploded views of an elongated outer tube 112 and an elongated inner rod member 113 in the extension tube assembly 110.

Figure 1:
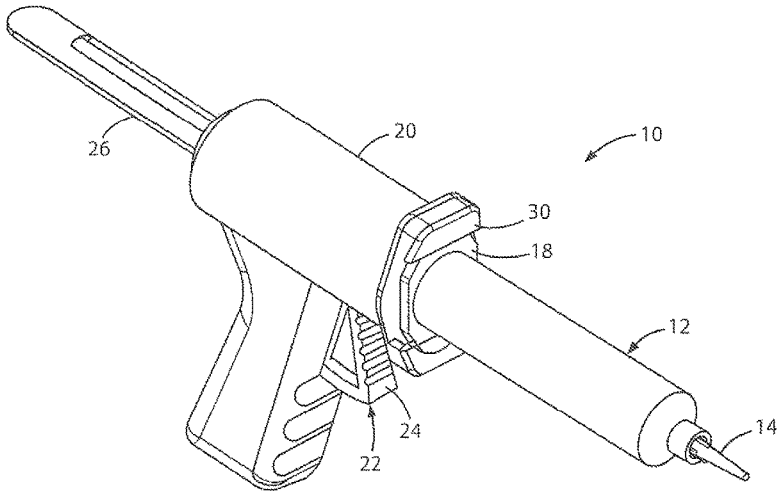
FIG. 1 (Prior Art)
FIG. 1 is a view of an existing adhesive dispensing gun when assembled with a syringe containing an adhesive material.
Figure 2:
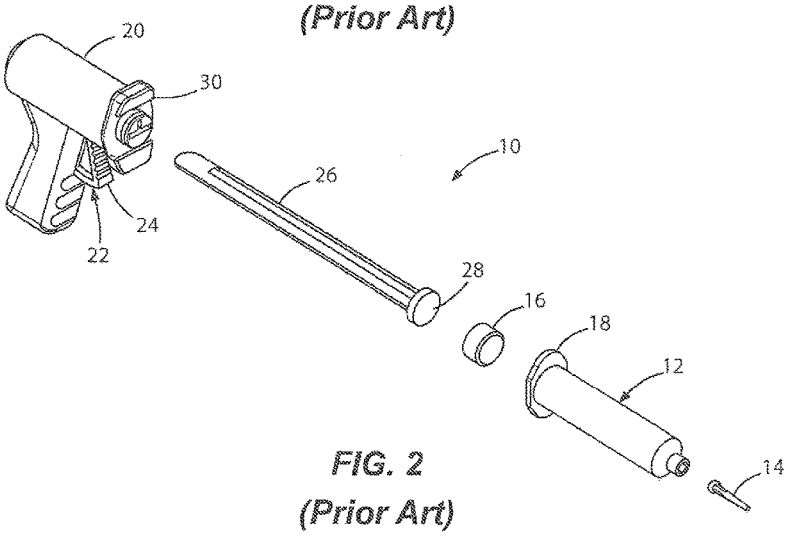
FIG. 2 (Prior Art)
FIG. 2 is an exploded view of the dispensing gun and syringe in FIG. 1.

The inventive adhesive gun dispensing system 100 extends the reach of a conventional dispensing gun 10 as in FIG. 1, so that an installer can easily and quickly apply a bead of adhesive material over a fiber routing path along ceilings, walls, crown moldings, and other elevated surfaces, without having to climb up and down a ladder multiple times during a given installation, The system 100 includes the extension tube assembly 110 having an overall length L. As mentioned, the assembly 110 includes the outer tube 112 and the inner rod member 113, wherein the rod member 113 is dimensioned for free axial movement inside the outer tube 112. The outer tube 112 may be formed, for example, of a plastics or light weight metallic material. The rod member 113 may also be made, e.g., of plastics or a light weight metal, and may be either solid or tubular in cross section.

The outer tube 112 incorporates a near end adapter 114 at a proximal or near end 115 of the tube 112, and a far end adapter 116 at a distal or far end 117 of the tube. The near end adapter 114 is comprised of a hollow cylindrical collar 118, and a third mount 120 is fixed at one axial end of the collar 118. The mount 120 is formed and dimensioned to engage the second mount 30 at the front end of the dispensing gun body 20 as shown in FIG. 3.

The end of the collar 118 opposite the mount 120 is inserted in the open near end 115 of the outer tube 112. The outer diameter of the collar 118 is such as to obtain a tight press fit when inserted in the tube 112. Alternatively or in addition, the collar 118 may be fixed within the end 115 of the tube 112 by use of an epoxy, adhesive, or mechanical fasteners.

The far end adapter 116 is comprised of a hollow cylindrical collar 122, and a fourth mount 124 fixed at one axial end of the collar 122. The mount 124 is dimensioned and formed to engage with the first mount 18 at the front end of the syringe 12 as shown in FIG. 3. The opposite end of the collar 122 is inserted in the open far end 117 of the tube 112. The outer diameter of the collar 122 is such as to obtain a tight press fit when inserted in the tube 112. Alternatively or in addition, the collar 122 may also be fixed within the end of the tube 112 by the use of an epoxy, adhesive, or mechanical fasteners.

After the adapters 114, 116 are press fit or otherwise incorporated at the ends of the outer tube 112, the inner rod member 113 is inserted axially through the tube 112. The rod member 113 is sized so that it passes freely through the adapters 114, 116 at the ends of the tube 112. The lengths of the rod member 113 and the outer tube 112 are determined by the required length L of the extension tube assembly 110. Typically, an extension length L of about two feet will be sufficient for most installations. It will be appreciated, however, that the extension tube assembly 110 may be constructed to provide an extension length L ranging from one foot to as much as eight feet.

To make use of the adhesive gun dispensing system 100 on site or beforehand, an installer attaches the mount 120 on the near end adapter 114 of the extension tube assembly 110, to the mount 30 provided on the body 20 of the dispensing gun 10. See FIG. 3. Next, if not already in place, the inner rod member 113 is inserted through the mount 124 on the far end adapter 116 to align the rod member 114 axially inside the outer tube 112 of the assembly 110.

The syringe 12 containing adhesive material is then attached to the mount 124 on the far end adapter 116, as shown in FIG. 3. If provided, an end cap over the nozzle end of the syringe 12 is removed, and replaced with the syringe nozzle 14 so that adhesive material contained in the syringe 12 can be dispensed through the nozzle.

Figure 7:
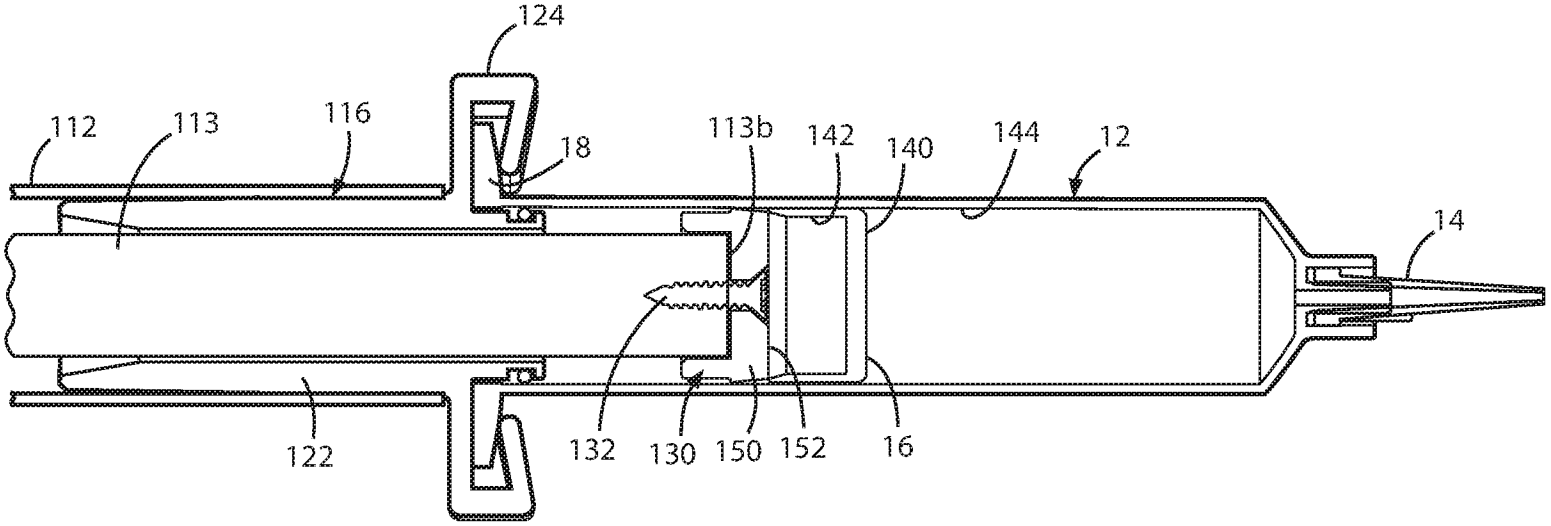
FIG. 7 is a sectional view of a leading portion of the dispensing system in FIG. 3 including the syringe.
Figure 8:
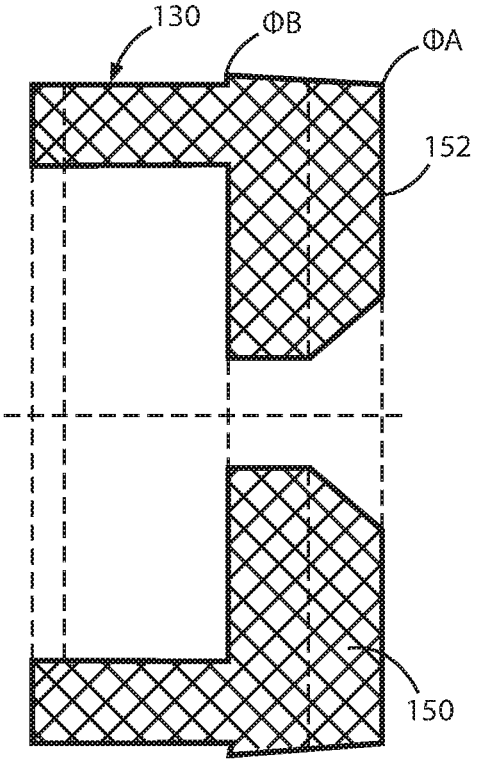
FIG. 8 is a sectional view of a plunger head according to the invention.

To dispense the adhesive, the installer repeatedly squeezes the trigger 24 on the gun body 20, causing the gun plunger 26 to abut the back end 113*a* of the inner rod member 113 and advance the member 113 forward. In turn, a plunger head 130 that is fixed coaxially to the leading end 113*b* of the rod member 113 engages the syringe piston 16 as shown in FIG. 7. The plunger head 130 then forces the piston 16 to urge the adhesive out of the syringe nozzle 14. FIG. 8 is a cross section of the plunger head 130 taken along the axis of the head 130 and the rod member 113.

The plunger head 130 may be fixed to the leading end 113*b* of the rod member 113 via a centered screw 132 as in FIGS. 4, 6, and 7, or by other mechanical fasteners or adhesives. Alternatively, the inside circumference of the plunger head 130 may be threaded to engage threads formed on the outside circumference of the leading end 113*b* of the rod member 113.

FIG. 7 shows the plunger head 130 at the leading end 113*b* of the rod member 113 when engaging the back of the syringe piston 16. As seen in FIG. 7, the piston 16 in not entirely solid, but it is in the shape of a hollow cup. A solid front end wall 140 of the piston 16 faces and acts directly on the adhesive in the syringe 12. A relatively thin cylindrical wall 142 extends rearward from the circumference of the front end wall 140, so that the piston wall 142 forms a seal against the inside surface 144 of the syringe 12.

To ensure reliable performance, the plunger head 130 at the leading end 113*b* of the rod member 113 must uniformly engage and push against the syringe piston 16 each time the installer pulls the gun trigger 24. If the force applied to the piston 16 through the rod member 113 is such as to cause the rear wall 142 of the piston to lose its seal along the inside surface 144 of the syringe, the adhesive is likely to ooze rearwardly over the outside surface of the piston 16. That is, if the force applied to the piston 16 is off center, or is too concentrated at the center of the piston, the chance of maintaining a good seal decreases. Escaping adhesive could move past the plunger head 130, the rod member 113, and migrate toward the far end adapter 116 and into the outer tube 112. Such a condition would result in wasted adhesive and make it more difficult for an installer to perform a neat installation. That is, the installer would need to be careful not to allow migrant adhesive to be deposited on walls, floors, furniture, tools, and other objects at the premises.

As shown in FIGS. 7 and 8, it has been found that if the outer diameter of the front wall 150 of the plunger head 130 tapers downwardly from a maximum diameter of ØB to a diameter of ØA at the leading end face 152 of the wall 150 i.e., ØA<ØB, the plunger head 130 will apply a substantially uniform forward and radially outward pressure on the relatively thin piston wall 142 at the rear end of the piston 16. For example, ØB=0.880 inch (22.35 mm) and ØA=0.851 inch (21.61 mm), and the axial length of the plunger head 130 between ØB and ØA is 0.2 inch (5.08 mm). As a result, the seal of the piston wall 142 against the inside surface 144 of the syringe 12 is enhanced, and the likelihood that adhesive will escape from the rear end of the syringe during use of the inventive system 100 is reduced.

It will also be appreciated that two or more of the inventive extension tube assemblies 110, each of a different overall length L, can be carried by an installer so that he or she can safely and quickly apply an adhesive over fiber routing paths having various elevations at a number of different premises, without using valuable installation time to climb up and down a ladder repeatedly at each premises.

While the foregoing represents preferred embodiments of the present invention, it will be understood by persons skilled in the art that various changes, modifications, and additions can be made without departing from the spirit and scope of the invention, and that the invention includes all such changes, modifications, and additions that are within the scope of the following claims.

I claim:

1. An extensible adhesive dispensing gun system, comprising:

a syringe for containing an adhesive, the syringe having a nozzle at a front end for applying the adhesive over a surface, a piston arranged for urging the adhesive out of the nozzle, and a first mount on a back end of the syringe opposite the nozzle;

a gun body having a front end, a second mount at the front end, a trigger mechanism contained in the gun body and responsive to operation of a trigger on the gun body, and an elongated plunger arranged to advance from the front end of the gun body in response to operation of the trigger mechanism; and an extension tube assembly including:

an elongated outer tube, a near end adapter, a far end adapter, a third mount on the near end adapter for engaging the second mount at the front end of the gun body, and a fourth mount on the far end adapter for engaging the first mount on the back end of the syringe; and an elongated inner rod member having a back end and a leading end, wherein the rod member is dimensioned and arranged for axial movement inside the outer tube, and the rod member has a plunger head at the leading end of the member so that when the gun plunger is urged by the trigger mechanism against the back end of the rod member, the plunger head on the rod member forces the piston in the syringe to urge the adhesive out of the nozzle;

wherein the far end adapter comprises a hollow cylindrical collar, the fourth mount is fixed at one axial end of the collar, and the end of the collar opposite the fourth mount is inserted in the open far end of the outer tube.

2. An extensible adhesive dispensing gun system according to claim 1, wherein the extension tube assembly has an overall length L in the range of from one to eight feet.

3. An extensible adhesive dispensing gun system according to claim 1, wherein the extension tube assembly has an overall length L of two feet.

4. An extensible adhesive dispensing gun system according to claim 1, wherein the near end adapter comprises a hollow cylindrical collar, the third mount is fixed at one axial end of the collar, and the end of the collar opposite the third mount is inserted in the open near end of the outer tube.

5. The dispensing gun system of claim 4, wherein the collar has an outer diameter determined to obtain a press fit when inserted in the near end of the outer tube.

6. The dispensing gun system of claim 4, wherein the collar is fixed within the near end of the outer tube with an epoxy, an adhesive, or mechanical fasteners.

7. The dispensing gun system of claim 1, wherein the collar has an outer diameter determined to obtain a press fit when inserted in the far end of the outer tube.

8. The dispensing gun system of claim 7, wherein the collar is fixed within the far end of the outer tube with an epoxy, an adhesive, or mechanical fasteners.

9. An extensible adhesive dispensing gun system according to claim 1, wherein the plunger head at the leading end of the inner rod member is formed and arranged for uniformly engaging and pushing against the piston in the syringe.

10. The dispensing gun system of claim 9, wherein the plunger head has a solid front wall, the front wall has a maximum diameter, and the diameter of the front wall tapers downwardly from the maximum diameter toward a leading end face of the wall, so that the plunger head applies a substantially uniform forward and radially outward pressure on a cylindrical wall of the piston for sealing the piston wall against an inside surface of the syringe.

11. The dispensing gun system of claim 10, wherein the maximum diameter of the front wall of the plunger head is 0.880 inch (22.35 mm), and the leading end face of the front wall has a diameter of 0.851 inch (21.61 mm).

12. An extensible adhesive dispensing gun system according to claim 1, wherein the elongated inner rod member is tubular.

* * * * *